US005988805A

United States Patent [19]

Meinhardt

[11] Patent Number: 5,988,805

[45] Date of Patent: Nov. 23, 1999

[54] CHIRAL SHAPED INK STICKS

[75] Inventor: Michael B. Meinhardt, Salem, Oreg.

[73] Assignee: Tektronix, Inc, Wilsonville, Oreg.

[21] Appl. No.: 08/994,913

[22] Filed: Dec. 19, 1997

Related U.S. Application Data

[63] Continuation-in-part of application No. 29/067,474, Mar. 10, 1997, application No. 29/067,477, Mar. 10, 1997, Pat. No. Des. 603,699, and application No. 29/067,478, Mar. 10, 1997, Pat. No. Des. 403,352.

[51] Int. Cl.[6] ..... B41J 2/175

[52] U.S. Cl. ..... 347/88; D18/56

[58] Field of Search ..... 347/99, 88; D18/56

[56] References Cited

U.S. PATENT DOCUMENTS

| | | | |
|---|---|---|---|
| D. 371,801 | 7/1996 | Jones et al. | D18/56 |
| D. 371,802 | 7/1996 | Jones et al. | D18/56 |
| D. 372,268 | 7/1996 | Jones et al. | D18/56 |
| D. 372,270 | 7/1996 | Jones et al. | D18/56 |
| D. 373,139 | 8/1996 | Jones et al. | D18/56 |
| D. 379,470 | 5/1997 | Gilbert | D18/56 |
| D. 379,471 | 5/1997 | Gilbert | D18/56 |
| D. 379,639 | 6/1997 | Gilbert | D18/56 |
| D. 379,640 | 6/1997 | Gilbert | D18/56 |
| D. 383,153 | 9/1997 | Jones et al. | D18/56 |
| D. 383,154 | 9/1997 | Jones et al. | D18/56 |
| 5,038,157 | 8/1991 | Howard | 346/140 |
| 5,510,821 | 4/1996 | Jones et al. | 347/88 |
| 5,784,089 | 7/1998 | Crawford | 347/88 |

FOREIGN PATENT DOCUMENTS

| | | |
|---|---|---|
| 0820872 | 7/1997 | European Pat. Off. . |
| 2305928 | 10/1995 | United Kingdom . |

*Primary Examiner*—Huan Tran
*Attorney, Agent, or Firm*—Ralph D'Alessandro; Francis I. Gray

[57] ABSTRACT

An ink stick shape for use in a printer ink stick feed chute is disclosed wherein the opposing sides of the ink stick are tapered or angled from the horizontal so that at least one area intermediate the top and the bottom of the ink stick is a greater distance from the horizontal than the junction of the side walls and the bottom of the ink stick. The ink stick shape or geometry may be keyed to a particular color.

16 Claims, 2 Drawing Sheets

CHIRAL SHAPED INK STICKS

This is a continuation-in-part of application Ser. Nos. 29/067,474, 29/067,477, U.S. Pat. No. Des. 603,699 and Ser. No. 29/067,478, U.S. Pat. No. Des. 403,352, all filed Mar. 10, 1997.

FIELD OF THE INVENTION

This invention relates generally to color printer inks and, more specifically, to the particular shape of the solid phase change ink sticks that may be used in the ink feed chutes of a phase change ink color printer. The number of specific ink stick shapes that may be employed to minimize the sticking of the solid ink sticks to the sides of the feed chutes as they are fed down the feed chutes to melt plates is increased. The ink sticks are melted by the melt plates and stored in the reservoir area in liquid form for ejection by the print head onto a receiving medium.

BACKGROUND OF THE INVENTION

Solid ink jet printers were first offered commercially in the mid-1980's. One of the first such printers was offered by Howtek Inc. and used pellets of colored cyan, yellow, magenta and black ink that were fed into shape coded openings that fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later more successful solid ink printers, such as the Tektronix Phaser® III and the Jolt printer offered by Dataproducts Corporation, used differently shaped solid ink sticks that were either gravity fed or spring loaded into a feed chute and pressed against a heater plate to melt the solid ink into its liquid form. These ink sticks were shape coded and of a generally small size. As phase change ink color printers increase their printing speed there is the need to provide larger sized ink sticks so that refill of the ink reservoir in the print head is less frequent and more output or prints can be produced between refills. Also, as the number of phase change ink printers increase it is desirable to use different shaped ink sticks with each model of printer that employs different ink formulations to minimize the potential for the inadvertent use of the incorrect ink in a particular printer since the inks and the printers are customized and made for each to optimize printer output. Current ink sticks employ shapes that have two mirror planes of symmetry.

Also, in printer designs where there is not a steep or generally vertical feed path to the heater plate, some provisions must be made to prevent the solid masses of shaped ink from sticking to the sides of the feed chutes so that regardless of the ink stick shapes employed an unrestricted feed of ink sticks proceeds down into the heater plate for melting. The melted ink then fills the individual colored ink reservoirs that are usually located within the print head. Larger sized ink sticks especially have the tendency to hang up or catch within the feed chutes when there is not a steep feed path to the melt plate, especially because of the sticky nature of the ink sticks' waxy exterior surfaces.

This problem is solved in the design of the ink stick masses of the present invention by the use of a drafted or tapered chiral design that presents only a small surface area for the ink stick to contact the adjacent wall of the feed chute. The opposing sides of the ink sticks extend between the top and the bottom surfaces at an angle.

SUMMARY OF THE INVENTION

It is an aspect of the present invention to provide a solid ink stick shape that introduces elements of asymmetry to solid ink stick shapes while maintaining a minimum surface area for contact with the sides of the solid stick ink feed chute.

It is another aspect of the present invention to provide a solid ink stick shape that is not superimposable on its mirror image.

It is a further aspect of the present invention to provide a solid ink stick shape that does not employ an internal mirror plane or internal mirror planes.

It is a feature of the present invention that the solid ink sticks of the present invention may possess an inversion center when viewed from a top plan view.

It is another feature of the present invention that the solid ink sticks of the present invention are tapered with non-superimposable mirror images or planes and are otherwise chiral in shape.

It is still another feature of the present invention that the solid ink sticks of the present invention are asymmetric when viewed from planes perpendicular and parallel to the top surface.

It is an advantage of the present invention that upside down loading of solid ink stick shapes into a ink stick feed chute of a printer is not possible.

It is another advantage of the present invention that an increased number of useful ink stick shapes is obtained for a possible design.

These and other aspects, features and advantages are obtained by the use of a solid ink stick that utilizes a tapered or drafted design on the opposing sides from the top surface to the bottom surface in combination with the absence of internal mirror planes to form a chiral design.

BRIEF DESCRIPTION OF THE DRAWINGS

These and other aspects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

As discussed hereafter in the context of the present invention, a plane of symmetry shall be understood to be a plane passing through an object such that the part on one side of the plane is the exact reflection of the part on the other side of the plane. The property of an object not being superimposable upon its mirror image shall define a chiral design. In other words, if a design is not superimposable on its mirror image, it is chiral. Chiral designs are asymmetric with respect to mirror planes taken through the ink stick in either the horizontal or vertical direction.

Figure 1:
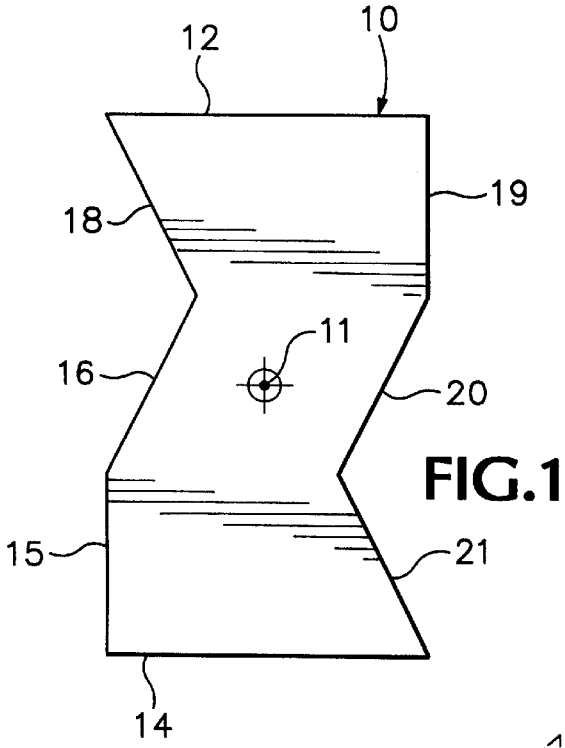
FIG. 1 is a top plan view of an ink stick shape illustrative of the present invention showing the location of the inversion center and the absence of internal mirror planes.

FIG. 1 shows a top plan view of a representative solid ink stick shape configuration indicated generally by the numeral 10 that when combined with a taper from top to bottom creates a shape that is not superimposable on its mirror images. FIG. 1 shows an ink stick design that is asymmetric with respect to mirror planes when the planes are taken horizontally or vertically through the object. The inversion center of the top surface of the object is shown as 11 and can be defined as having the characteristic that each and every point in the plane can be taken through the inversion center an equal distance to obtain exactly the same surface. In other words, the inversion center is that point through which a line is passed and along which there exists two points topologically equivalent and equidistant from the inversion center. Ink stick 10 has two opposing ends 12 and 14 and opposing sides 15, 16, 18, 19, 20 and 21. Ink stick 10 has no internal mirror image planes.

Figure 2:
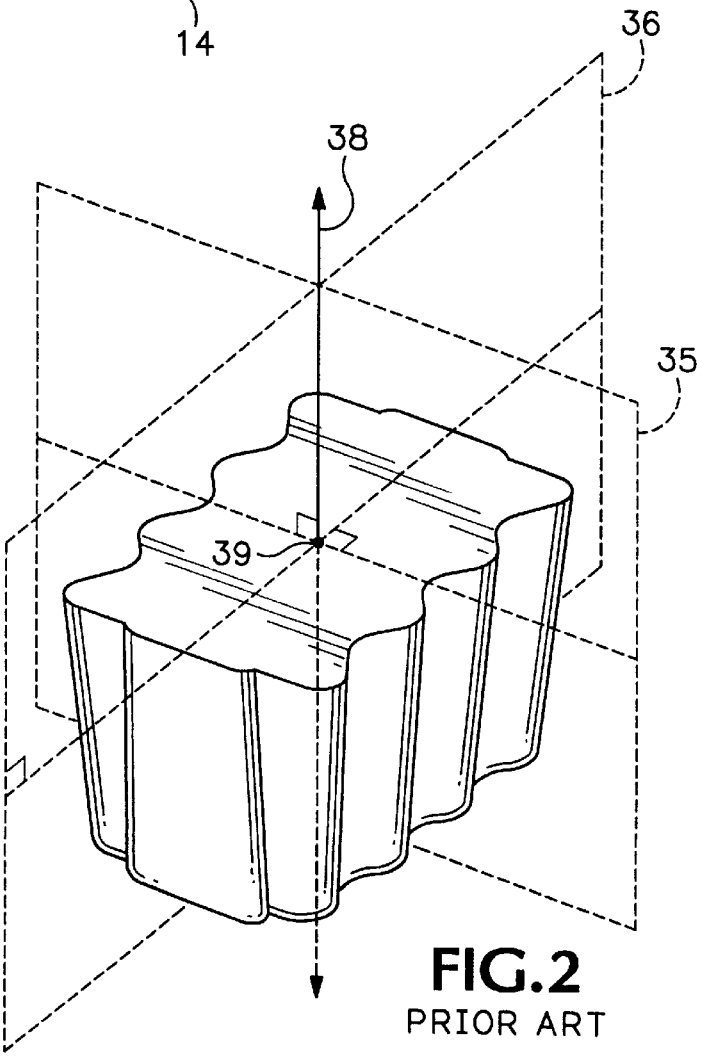
FIG.2 PRIOR ART
FIG. 2 is a view of a prior art solid ink stick showing internal mirror planes or planes of symmetry taken vertically through the inversion center of the top surface.

FIG. 2 in contrast shows a prior art ink stick design with the internal mirror planes shown created by the two planes of symmetry 35 and 36 taken through the axis of symmetry 38 that passes through the inversion center 39 for the top surface.

Figure 3:
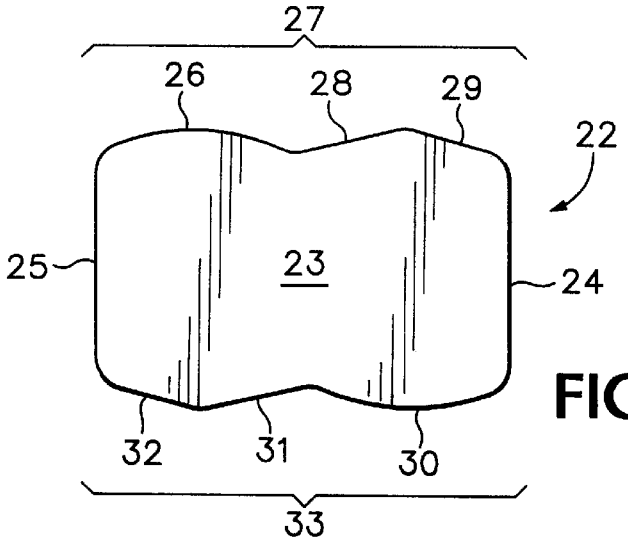
FIG. 3 is a top plan view of an ink stick shape illustrative of the present invention.
Figure 4:
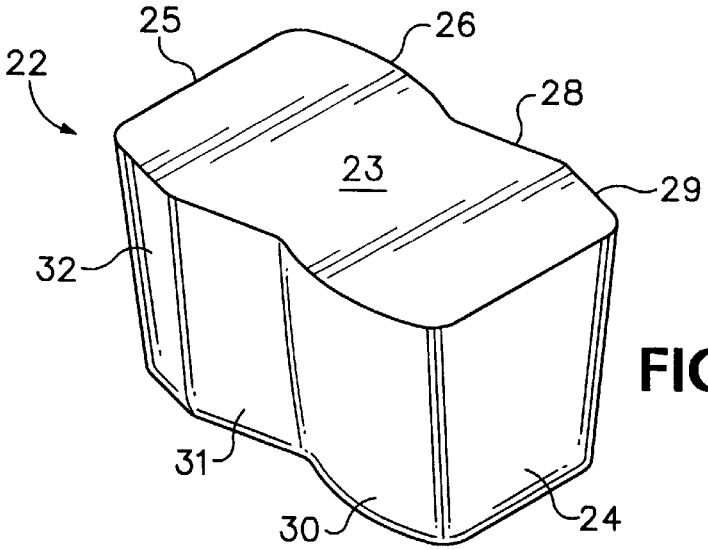
FIG. 4 is a side perspective view of the ink stick of FIG. 3 that is illustrative of the design of the present invention.
Figure 5:
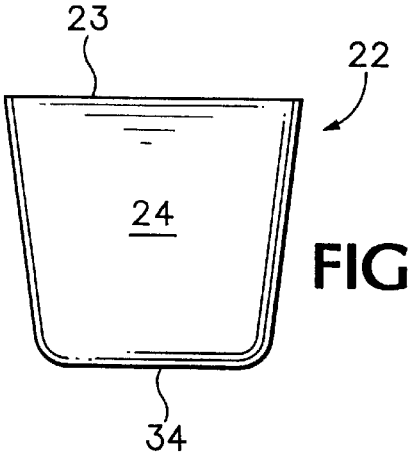
FIG. 5 an end elevational view of the ink stick of FIG. 3 that is illustrative of the present invention showing the tapering of the ink stick from top to bottom.

FIG. 3 shows a top plan view of a representative solid ink stick configuration indicated generally by the numeral 22. Ink stick 22 has a front end 24 and an opposing rear end 25. Ink stick 22 has an illustrative design with a first side 27 formed by tapered or angled from the vertical side portions 26, 28, 29 and a second opposing side 33 formed by tapered or angled from the vertical side portions 30, 31 and 32. The taper of the opposing sides 26, 28 and 29, and 30, 31 and 32 is best seen in the end view FIG. 5 as they taper from the top 23 to the opposing bottom 33. The opposing sides can be flat, arcuate or have portions that are any combination thereof as illustrated by ink stick 22 to achieve the desired aesthetic appearance. For example, side portions 28, 29, 31 and 32 are flat and individually or collectively portions 28 and 29, as well as portions 31 and 32 can comprise less than about 50% of the length of the ink stick. Side portions 26 and 30 are arcuate.

When employed in a chiral shaped ink stick, the tapering of the opposing sides from the top to the bottom prevents the mirror planes in the horizontal direction from being superimposable. The vertical plane asymmetry of the ink stick, when coupled with the tapering between the top and bottom surfaces, prevents the superimposability of the design.

It should be noted that the solid phase change ink employed in the ink sticks 10 and 22 of the instant invention can be any appropriate phase change ink that employs a suitable colorant, such as dye or a colored resin, and an ink carrier composition which is compatible with the colorant. Such a suitable composition is described in any one of U.S. Pat. application Ser. No. 08/671,998 filed Jun. 28, 1996; U.S. Pat. No. 5,372,852 issued Dec. 13, 1994 and U.S. Pat. No. 4,889,560 issued Dec. 26, 1989, all assigned to the assignee of the present invention, which are herein specifically incorporated by reference in pertinent part. The phase change ink of an appropriate composition can employ a carrier composition that utilizes a fatty-amide containing material which may be any appropriate amide compound, such as typically a tetra-amide, and/or a tri-amide compound and/or a mono-amide compound or other suitable amides, and combinations thereof. Alternatively, it can employ a urethane resin, a mixed urea/urethane resin and a monoamide or any other carrier composition appropriate for jetting from a hot melt ink jet printer. As described in the above referenced U.S. patents and pending application, the appropriate colorant can be employed to achieve cyan, magenta, yellow and black colors suitable for ink jet subtractive color printing applications.

While the invention has been described above with reference to specific embodiments thereof, it is apparent that many changes, modifications and variations in the materials, arrangements of parts and steps can be made without departing from the inventive concept disclosed herein. For example, in employing the solid ink stick configuration or shape of the present invention, it should be noted that the ink sticks 10 or 22 can be formed by any suitable process such as molding, extruding, or pouring into a container for shipping in which the ink cools and solidifies. The opposing top and bottom planar surfaces 23 and 33 can be of any shape, such as rounded or pointed, as well as the preferred generally planar shown.

Having thus described the invention, what is claimed is:

1. An ink stick for use in a printer having, in combination:

(a) a top surface and an opposing bottom surface, the bottom surface not being superimposable on the top surface; and (b) at least a first side and at least an opposing second side connecting the top surface and the opposing bottom surface at junctions, the at least first side and at least opposing second side being shaped so that a plane taken vertically through the top and opposing bottom surface does not create mirror images that are superimposable and the at least first side and at least opposing second side further being at least partly angled from a vertical line through at least one of the junctions such that one area intermediate the top surface and the bottom surface is a greater distance from the vertical line than at least one of the junctions.

2. The ink stick according to claim 1 further including a front surface and an opposing rear surface connecting the top surface and the bottom surface.

3. The ink stick according to claim 1 wherein the top surface of the ink stick has an inversion center.

4. The ink stick according to claim 2 wherein the ink stick is asymmetric when viewed from planes both perpendicular and parallel to the top surface.

5. The ink stick according to claim 2 wherein the ink stick is chiral in design.

6. The ink stick according to claim 1 wherein the one area intermediate the top surface and the opposing bottom surface is central therebetween.

7. The ink stick according to claim 1 wherein the one area intermediate the top surface and the opposing bottom surface is adjacent the bottom surface.

8. The ink stick according to claim 1 wherein the one area intermediate the top surface and the opposing bottom surface is adjacent the top surface.

9. The ink stick according to claim 1 wherein the ink stick has a length defined between a front surface and an opposing rear surface, the at least first side further having at least one flat portion.

10. The ink stick according to claim 1 wherein the ink stick has a length defined between a front surface and an opposing rear surface, the at least opposing second side further having at least one flat portion.

11. The ink stick according to claim 9 wherein the at least one flat portion comprises less than about 50% of the length of the ink stick.

12. The ink stick according to claim 10 wherein the at least one flat portion comprises less than about 50% of the length of the ink stick.

13. An ink stick for use in a printer having, in combination:

(a) a top surface and an opposing bottom surface, the bottom surface not being superimposable on the top surface; and (b) at least a first side and at least an opposing second side connecting the top surface and the opposing bottom surface at junctions, the at least first side and at least opposing second side being shaped so that the ink stick is asymmetric in either the vertical direction when cut by a plane taken vertically through the top surface and the opposing bottom surface or the horizontal direction when cut by a plane taken horizontally through the at least first side and the at least opposing second side.

14. The ink stick according to claim 13 further including a front surface and an opposing rear surface connecting the top surface and the bottom surface.

15. The ink stick according to claim 13 wherein the top surface of the ink stick has an inversion center.

16. The ink stick according to claim 13 wherein the ink stick is chiral in design.

* * * * *